US012421978B2

(12) United States Patent
Lu et al.

(10) Patent No.: US 12,421,978 B2
(45) Date of Patent: Sep. 23, 2025

(54) FAN MODULE

(71) Applicant: Giga Computing Technology Co., Ltd., New Taipei (TW)

(72) Inventors: Chia-Chen Lu, New Taipei (TW); Ching-Chuan Huang, New Taipei (TW)

(73) Assignee: Giga Computing Technology Co., Ltd., New Taipei (TW)

( * ) Notice: Subject to any disclaimer, the term of this patent is extended or adjusted under 35 U.S.C. 154(b) by 0 days.

(21) Appl. No.: 18/748,050

(22) Filed: Jun. 19, 2024

(65) Prior Publication Data

US 2025/0122885 A1 Apr. 17, 2025

(30) Foreign Application Priority Data

Oct. 12, 2023 (TW) ..... 112138855

(51) Int. Cl.
*F04D 29/52* (2006.01)
*F04D 19/00* (2006.01)
*F04D 29/64* (2006.01)

(52) U.S. Cl.
CPC ..... *F04D 29/522* (2013.01); *F04D 19/002* (2013.01); *F04D 29/644* (2013.01)

(58) Field of Classification Search
CPC .... F04D 19/002; F04D 29/522; F04D 29/644; H05K 7/20172
See application file for complete search history.

(56) References Cited

U.S. PATENT DOCUMENTS 6,435,889 B1 * 8/2002 Vinson ..... H01R 13/745 439/247
6,493,225 B2 * 12/2002 Chuang ..... H05K 7/20172 415/176
8,721,276 B2 * 5/2014 Lu ..... F04D 25/0613 415/213.1
2002/0025727 A1 * 2/2002 Shy ..... H05K 7/20172 439/660
2002/0093255 A1 * 7/2002 Matsumoto ..... F04D 25/0613 310/63

(Continued)

FOREIGN PATENT DOCUMENTS

CN 102541214 4/2016
CN 107450696 12/2017
TW M529759 10/2016

*Primary Examiner* — Nathaniel E Wiehe
*Assistant Examiner* — Jackson N Gillenwaters
(74) *Attorney, Agent, or Firm* — JCIPRNET

(57) ABSTRACT

A fan module includes a fan, a fan frame, a pair of quick release brackets, and a connector set. The fan frame has a bottom wall and sidewalls surrounding the bottom wall to form an accommodating space. The fan is suitable for being placed in the accommodating space. The quick release brackets are assembled at two opposite sides of the fan. The connector set includes first and second connectors. The first connector is fixed at one of the quick release brackets. The second connector is fixed at the fan frame. When the fan is placed at the accommodating space, the first connector and the second connector are inserted into each other, and an orthographic projection of the first connector at the bottom wall of the fan frame falls within a range of an orthographic projection of the quick release bracket at the bottom wall of the fan frame.

8 Claims, 7 Drawing Sheets

(56) References Cited

U.S. PATENT DOCUMENTS

| | | | | |
|---|---|---|---|---|
| 2005/0037660 | A1 | 2/2005 | Chang et al. | |
| 2013/0108436 | A1* | 5/2013 | He | F04D 19/002 415/213.1 |
| 2017/0042060 | A1* | 2/2017 | Chen | F04D 25/0613 |
| 2022/0065268 | A1* | 3/2022 | Lu | F04D 19/007 |

* cited by examiner

FAN MODULE

CROSS-REFERENCE TO RELATED APPLICATION

This application claims the priority benefit of Taiwan application serial no. 112138855, filed on Oct. 12, 2023. The entirety of the above-mentioned patent application is hereby incorporated by reference herein and made a part of specification.

BACKGROUND OF THE INVENTION

Field of the Invention

The invention relates to a fan module, and in particular, to a fan module having good heat dissipation effect.

Description of Related Art

In order to facilitate quick replacement and maintain system operation, server fan structures often adopt quick-release structures as a means of disassembly and assembly. However, the distance between fans is varied depending on the width of the cables used, resulting in a greater distance between fans.

FIG. 1 is a schematic diagram of a conventional fan module. Please refer to FIG. 1. In the prior art, a first connector 11 is disposed on an outer wall 12*a* of a quick release bracket 12 relatively away from a fan 13, so as to be inserted into a second connector 15 disposed on the inner sidewall of a fan frame 14. Such an arrangement ensures that there is a certain distance G between two fans 13 due to the arrangement positions of the first connector 11 and the second connector 15.

When the fan module 1 is activated, a cavity is generated in the distance G between the two fans 13, and this cavity is an ineffective airflow area. As a result, the overall heat dissipation effect of the fan module 1 is affected.

Therefore, how to reduce the distance G between two fans 13 is an urgent issue to be solved.

SUMMARY OF THE INVENTION

The invention provides a fan module having good heat dissipation effect.

A fan module of the invention includes a fan, a fan frame, a pair of quick release brackets, and a connector set. The fan frame has a bottom wall and a plurality of sidewalls surrounding the bottom wall to form an accommodating space, wherein the fan is suitable for being placed in the accommodating space. The quick release brackets are assembled at two opposite sides of the fan. The connector set includes a first connector and a second connector, wherein the first connector is fixed to one of the quick release brackets, and the second connector is fixed to the fan frame, and when the fan is placed in the accommodating space, the first connector and the second connector are inserted into each other, and an orthographic projection of the first connector at the bottom wall of the fan frame falls within a range of an orthographic projection of the quick release bracket at the bottom wall of the fan frame.

In an embodiment, the first connector is a male connector, and the second connector is a female connector.

In an embodiment, the first connector includes a first circuit board, a plurality of first cables, a plurality of first terminals, and a first alignment structure, the first cables are fixed at the first circuit board, and the first terminals are disposed at the first alignment structure and electrically connected to the first circuit board.

In an embodiment, the first alignment structure is a plurality of plugs, and the first terminals are distributed on two opposite surfaces of the plugs.

In an embodiment, the second connector includes a second circuit board, a plurality of second cables, a plurality of second terminals, and a second alignment structure, wherein the second cables are fixed at the second circuit board, and the second terminals are disposed at the second alignment structure and electrically connected to the second circuit board.

In an embodiment, the second alignment structure is a plurality of sockets, and the second terminals are protruded beyond a surface of the sockets facing the plugs to be suitable for contact with the first terminals.

In an embodiment, the first circuit board has a pair of first locking portions for a plurality of fasteners to pass through correspondingly, so as to lock the first circuit board to one of the quick release brackets.

In an embodiment, a pair of quick release brackets include a first quick release bracket and a second quick release bracket, and the first circuit board is locked to the first quick release bracket.

In an embodiment, the first quick release bracket has an escape space, and the first connector is located in the escape space.

In an embodiment, the second circuit board has a pair of second locking portions for a plurality of fasteners to pass through correspondingly, the fan frame also includes a plurality of studs disposed at the bottom wall and close to one of the sidewalls, and the fasteners pass through the second locking portions and are locked into the studs to fix the second circuit board to the fan frame.

In an embodiment, each of the quick release brackets has a body portion and a handle portion, and the handle portion is pivoted at a side of the body portion and may be rotated relative to the body portion.

Based on the above, in the fan module of the invention, by making the orthographic projection of the first connector fixed on the quick release bracket at the bottom wall of the fan frame fall within the range of the orthographic projection of the quick release bracket at the bottom wall of the fan frame, the distance between fans may be effectively reduced, ineffective cavities may be reduced, and a more effective airflow field may be formed, thereby improving the overall heat dissipation effect of the fan module.

DESCRIPTION OF THE EMBODIMENTS

Figure 2A:
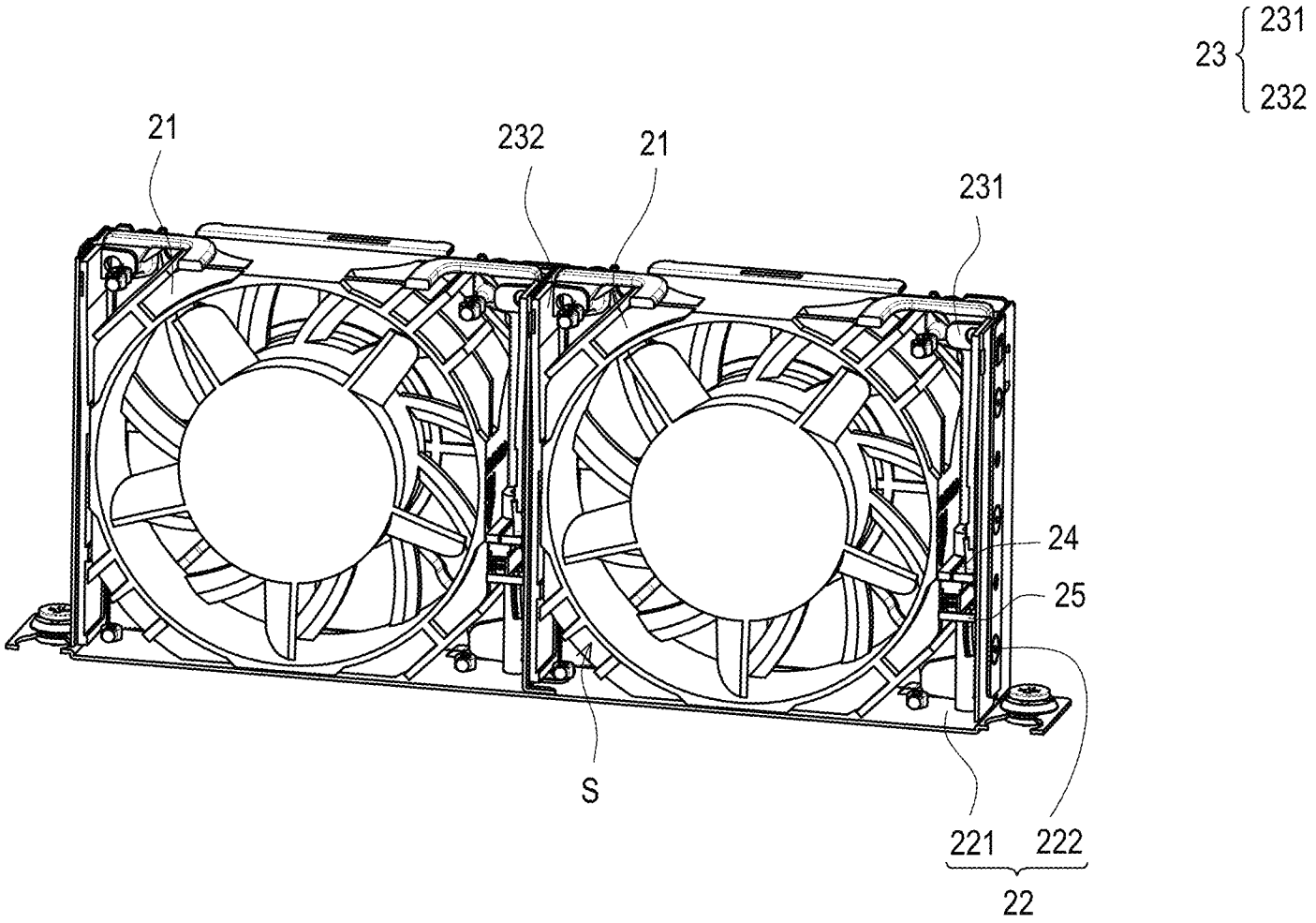
FIG. 2A is a schematic diagram of a fan module of an embodiment of the invention.
Figure 2B:
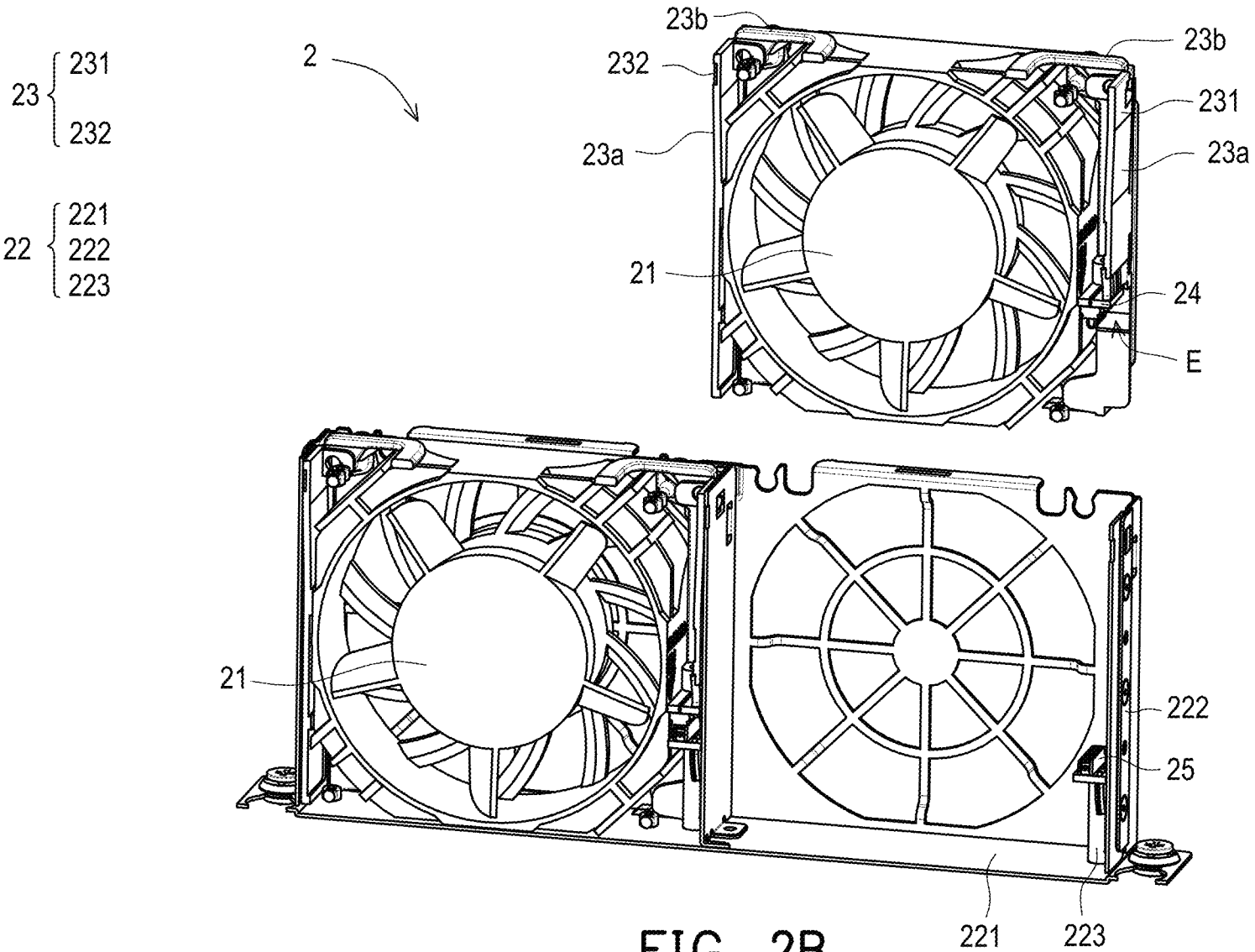
FIG. 2B is a schematic diagram of one fan separated from the fan frame in the fan module of FIG. 2A.

FIG. 2A is a schematic diagram of a fan module of an embodiment of the invention, and FIG. 2B is a schematic diagram of one fan separated from the fan frame in the fan module of FIG. 2A. Please refer to FIG. 2A and FIG. 2B at the same time. A fan module 2 includes a fan 21, a fan frame 22, a pair of quick release brackets, and a connector set. The fan frame 22 has a bottom wall 221 and a plurality of sidewalls 222 surrounding the bottom wall 221 to form an accommodating space S, wherein the fan 21 is suitable for being placed in the accommodating space S.

One quick release bracket 23 is assembled at two opposite sides of the fan 21 respectively. The connector set includes a first connector 24 and a second connector 25, wherein the first connector 24 is fixed to one of the quick release brackets 23, and the second connector 25 is fixed on the fan frame 22, and the configuration position of the second connector 25 corresponds to the configuration position of the first connector 24. Therefore, when the fan 21 is placed in the accommodating space S, the first connector 24 and the second connector 25 are inserted into each other. In the present embodiment, the orthographic projection of the first connector 24 at the bottom wall 221 of the fan frame 22 falls within the range of the orthographic projection of the quick release bracket 23 at the bottom wall 221 of the fan frame 22.

Figure 2C:
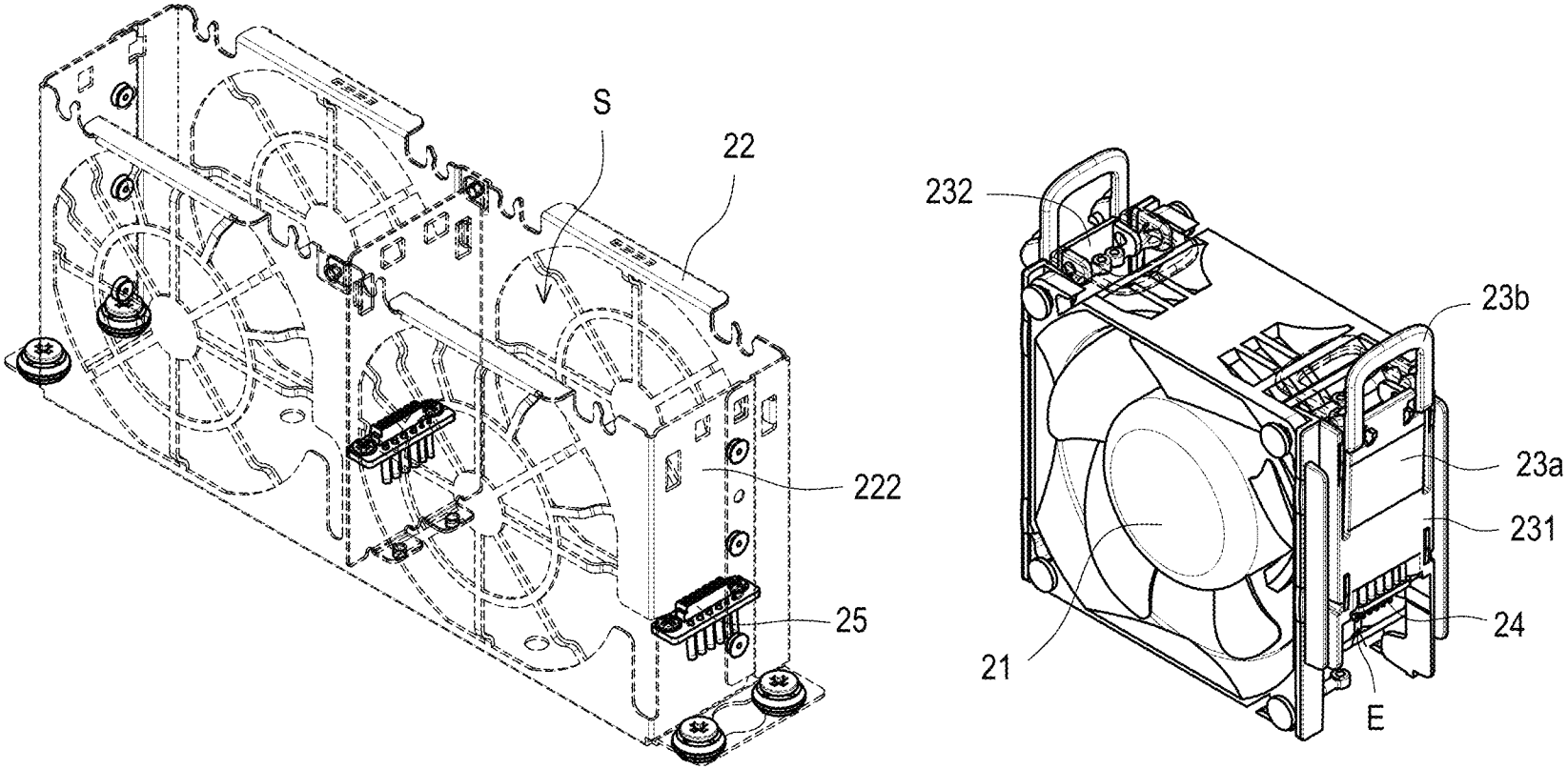
FIG. 2C is a schematic diagram of one fan and the fan frame in FIG. 2B from another perspective.
Figure 2D:
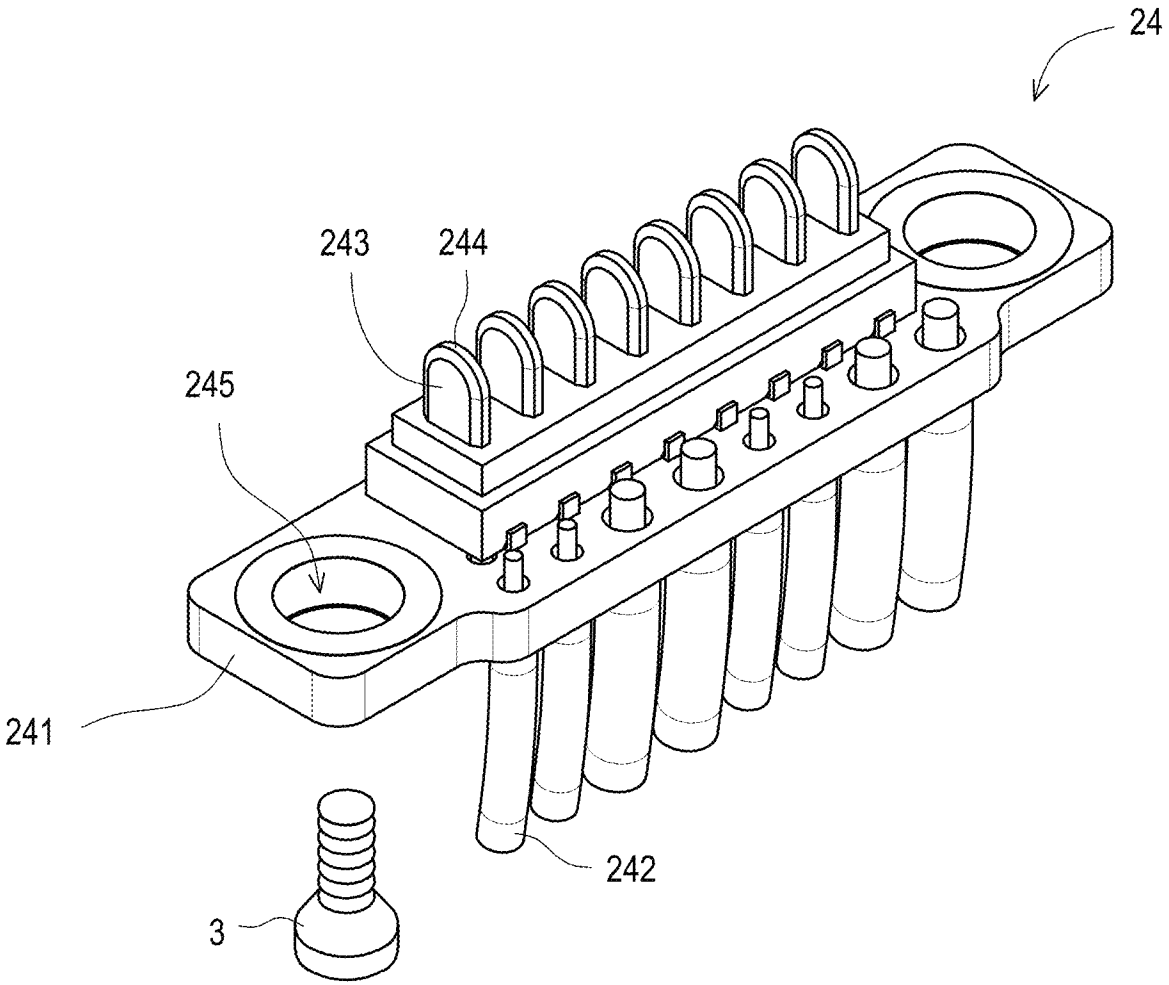
FIG. 2D is a schematic diagram of a first connector.
Figure 2E:
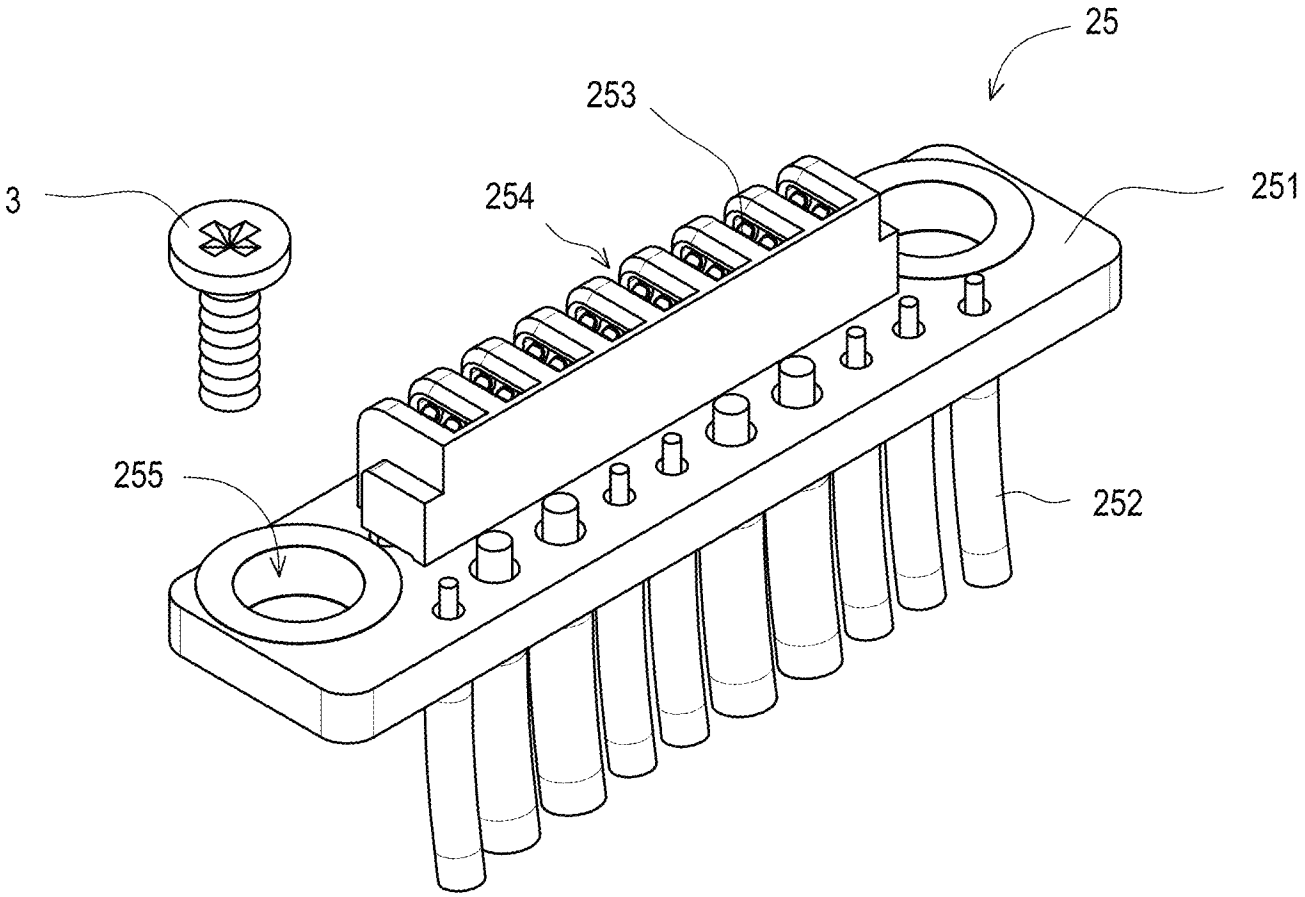
FIG. 2E is a schematic diagram of a second connector.

FIG. 2C is a schematic diagram of one fan and the fan frame in FIG. 2B from another perspective. FIG. 2D is a schematic diagram of a first connector, and FIG. 2E is a schematic diagram of a second connector. Please refer to FIG. 2C, FIG. 2D, and FIG. 2E at the same time. The structures of the above two quick release brackets 23 are different. Specifically, a pair of quick release brackets 23 have a first quick release bracket 231 and a second quick release bracket 232, wherein the first quick release bracket 231 has an escape space E, and the first connector 24 is assembled to the first quick release bracket 231, and the first connector 24 is located in the escape space E. Moreover, the first quick release bracket 231 and the second quick release bracket 232 respectively have a body portion 23*a* and a handle portion 23*b*, wherein the body is assembled to the fan 21, and the handle portion 23*b* is pivoted at a side of the body portion 23*a* so as to be rotatable relative to the body portion 23*a*.

The first connector 24 is a male connector, and the second connector 25 is a female connector.

The first connector 24 includes a first circuit board 241, a plurality of first cables 242, a plurality of first terminals 243, and a first alignment structure 244. The first cables 242 are fixed at the first circuit board 241, and the first terminals 241 are disposed at the first alignment structure 244 and electrically connected to the first cables 242 via the first circuit board 241. The first alignment structure 244 is a plurality of plugs, and the first terminals 243 are distributed on two opposite surfaces of the plugs. In the present embodiment, the first terminals 243 are pads formed on two opposite surfaces of the plugs.

In addition, the first circuit board 241 has a pair of first locking portions 245, and the first locking portions 245 allow the fasteners 3 to pass through correspondingly, so as to lock the first circuit board 241 to the first quick release bracket 231.

The second connector 25 includes a second circuit board 251, a plurality of second cables 252, a plurality of second terminals 253, and a second alignment structure 254, wherein the second cables 252 are fixed at the second circuit board 251, and the second terminals 253 are disposed at the second alignment structure 254 and electrically connected to the second cables 252 via the second circuit board 251. The second alignment structure 254 is a plurality of sockets, and the second terminals 253 are protruded beyond the surface of the sockets facing the plugs to be suitable for contact with the first terminals 243.

In addition, the second circuit board 251 has a pair of second locking portions 255 for the fasteners 3 to pass through correspondingly, the fan frame 22 also includes a plurality of studs 223 (shown in FIG. 2B) disposed at the bottom wall 221 and close to one of the sidewalls 222, and the fasteners 3 pass through the second locking portions 255 and are locked into the studs 223 (shown in FIG. 2B) to fix the second circuit board 251 to the fan frame 22.

Referring to FIG. 2C, the user may first assemble the first connector 24 to the first quick release bracket 231 and fix the second connector 25 to the fan frame 22. In addition, the first quick release bracket 231 and the second quick release bracket 232 are assembled to two sides of the fan 21 respectively.

When the fan 21 assembled with the quick release bracket 23 is to be assembled to the fan frame 22, the handle portion 23*b* of the quick release bracket 23 may be rotated relative to the body portion 23*a*, so that the handle portion 23*b* is changed from a state of abutting the fan 21 to standing upright at the body portion 23*a*. In this way, the user may put a finger through the handle portion 23*b* to readily extract the fan 21.

Next, as shown in FIG. 2B, the fan 21 is placed in the accommodating space S of the fan frame 22.

Figure 3:
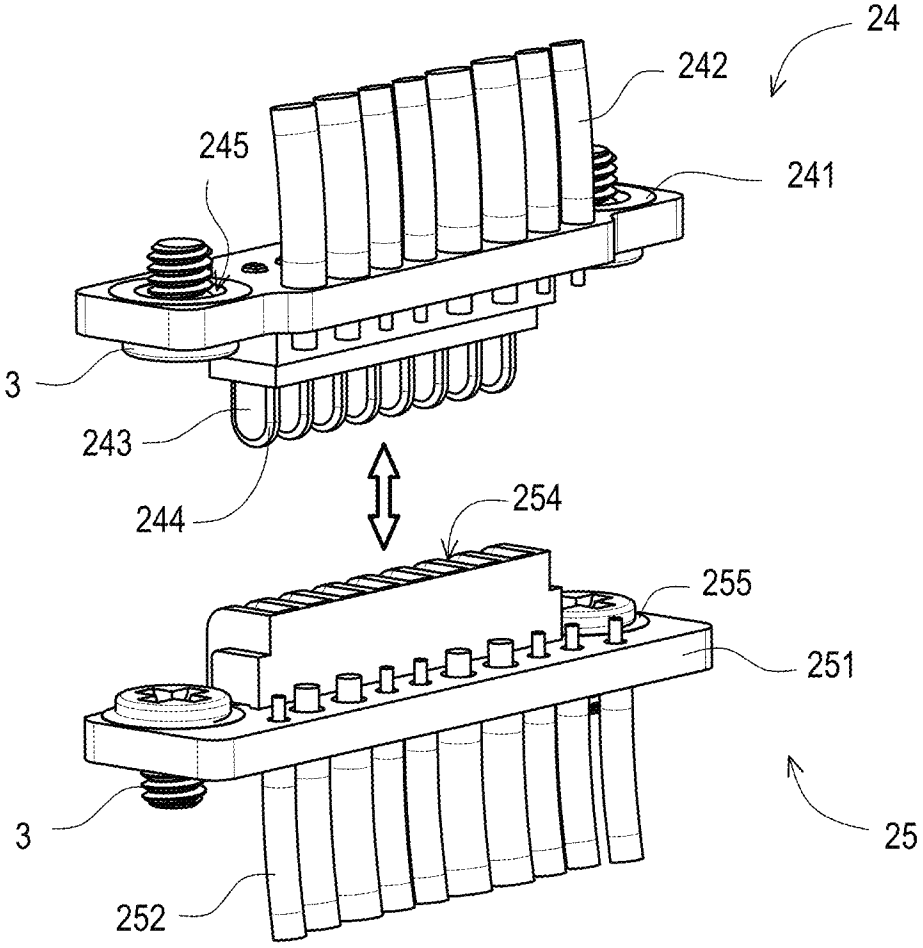
FIG. 3 is a schematic diagram of the corresponding insertion of the first connector and the second connector.

FIG. 3 is a schematic diagram of the corresponding insertion of a first connector and a second connector. Please refer to FIG. 2B and FIG. 3 at the same time. As the fan 21 goes deep into the accommodating space S, the first connector 24 is in contact with the second connector 25 and inserted into the second connector 25. Specifically, the first alignment structure (plug) 244 of the first connector 24 corresponds to the second alignment structure (socket) 254 inserted into the second connector 25. When the first alignment structure 244 as the plug and the second alignment structure 254 as the socket are inserted into each other correspondingly, the first terminals 243 disposed on two opposite surfaces of the plugs are in contact with the second terminals 253 protruded beyond the surface of the socket facing the plugs, so that the first connector 24 and the second connector 25 may achieve electrical conduction.

In this way, as shown in FIG. 2A, the fan 21 is well assembled in the fan frame 22.

After the fan 21 is assembled in the fan frame 22, the handle portion 23*b* that may be pivoted relative to the body portion 23*a* is rotated from an upright state to a state of abutting the fan 21. In this way, the overall volume of the fan module 2 may be reduced.

Figure 1:
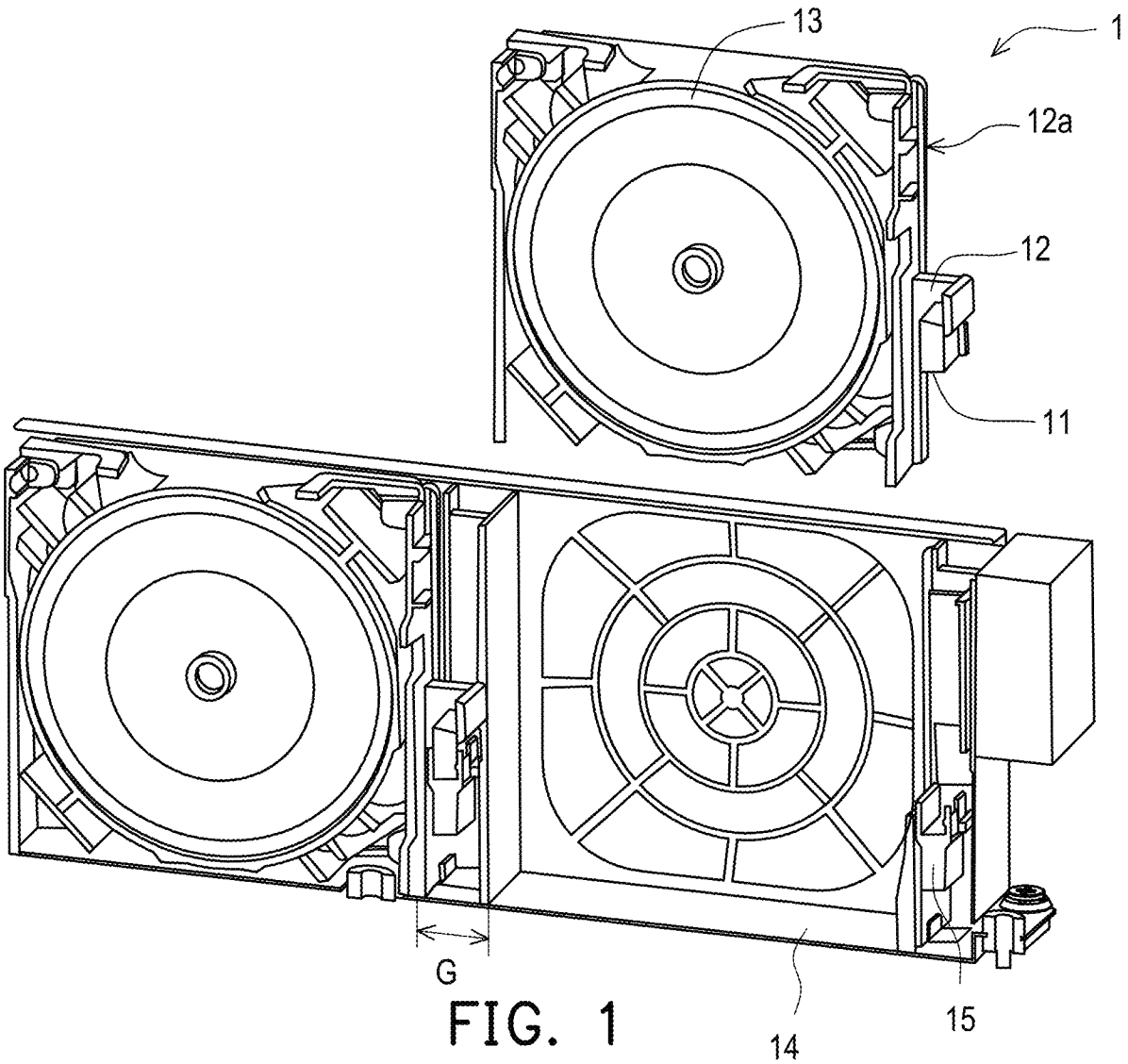
FIG. 1 is a schematic diagram of a conventional fan module.

It may be seen from the fan module 2 of FIG. 2A that compared to the fan module 1 of FIG. 1, in the present embodiment, the structures of the first connector 24 and the second connector 25 are changed, and the position of the first connector 24 is changed, so that the orthographic projection of the first connector 24 at the bottom wall 221 of the fan frame 22 falls within the range of the orthographic projection of the quick release bracket 23 at the bottom wall 221 of the fan frame 22. Compared with the conventional fan module 1, the two fans 21 in the fan module 2 of the present embodiment are arranged closer together, that is, the distance between the two fans 21 is shortened. Therefore, the generation of cavities may be avoided, thereby forming an effective airflow field shape and improving the overall heat dissipation effect of the fan module 2.

In addition, since the structures of the first connector 24 and the second connector 25 in the present embodiment are different from the structures of the connectors in the conventional fan module 2, and the arrangement of the first connector 24 and the second connector 25 is also different from the arrangement of the connectors in the conventional fan module 1, the space limitation of the structure of the conventional connector on the cables may be overcome, and high-voltage resistant cables may be selected to improve the current withstanding capability of the fan module 2.

Based on the above, in the fan module of the invention, via the configuration architecture in which the orthographic projection of the first connector fixed on the quick release bracket at the bottom wall of the fan frame falls within the range of the orthographic projection of the quick release bracket at the bottom wall of the fan frame, the distance between fans in the fan module may be effectively reduced, ineffective cavities may be reduced, and a more effective airflow field may be formed, thereby improving the overall heat dissipation effect of the fan module.

In addition, the arrangement of the first connector and the second connector in the fan module of the invention is different from the arrangement of the connectors in the conventional fan module, and the structures of the first connector and the second connector are further different from the structures of the connectors in the conventional fan module. Therefore, the space limitation of the arrangement architecture of connectors for the cables in the conventional fan module is overcome, and high-voltage resistant cables may be selected according to needs, thereby improving the current withstanding capability of the fan module.

What is claimed is:

1. A fan module, comprising:

a fan;

a fan frame having a bottom wall and a plurality of sidewalls surrounding the bottom wall to form an accommodating space, wherein the fan is suitable for being placed in the accommodating space;

a pair of quick release brackets assembled at two opposite sides of the fan; and a connector set comprising a first connector and a second connector, wherein the first connector is fixed at one of the quick release brackets, and the second connector is fixed at the fan frame, wherein when the fan is placed in the accommodating space, the first connector and the second connector are inserted into each other, and an orthographic projection of the first connector at the bottom wall of the fan frame falls within a range of an orthographic projection of the corresponding quick release bracket at the bottom wall of the fan frame, wherein the first connector comprises a first circuit board, a plurality of first cables, a plurality of first terminals, and a first alignment structure, the first cables and the first alignment structure are fixed at opposite sides of the first circuit board, and the first terminals are disposed at the first alignment structure and electrically connected to the first cables through the first circuit board, wherein the second connector comprises a second circuit board, a plurality of second cables, a plurality of second terminals, and a second alignment structure, the second cables and the second alignment structure are fixed at opposite sides of the second circuit board, and the second terminals are disposed and protruded from at least one of opposite surfaces of the second alignment structure and electrically connected to the second cable through the second circuit board, wherein the first alignment structure plugs into the second alignment structure with the first terminals contacting the second terminals.

2. The fan module of claim 1, wherein the first connector is a male connector and the second connector is a female connector.

3. The fan module of claim 1, wherein the first alignment structure is a plurality of plugs.

4. The fan module of claim 1, wherein the first circuit board has a pair of first locking portions for a plurality of fasteners to pass through correspondingly, so as to lock the first circuit board to one of the pair of quick release brackets.

5. The fan module of claim 4, wherein the pair of quick release brackets comprise a first quick release bracket and a second quick release bracket, and the first circuit board is locked to the first quick release bracket.

6. The fan module of claim 5, wherein the first quick release bracket has an escape space, and the first connector is located in the escape space.

7. The fan module of claim 4, wherein the second circuit board has a pair of second locking portions for a plurality of fasteners to pass through correspondingly, the fan frame also comprises a plurality of studs disposed at the bottom wall and adjacent to one of the sidewalls, and the fasteners pass through the second locking portions and are locked into the studs to fix the second circuit board to the fan frame.

8. The fan module of claim 1, wherein each of the quick release brackets has a body portion and a handle portion, and the handle portion is pivoted at a side of the body portion and may be rotated relative to the body portion.

* * * * *